US009469024B2

(12) United States Patent
Bensman et al.

(10) Patent No.: US 9,469,024 B2
(45) Date of Patent: Oct. 18, 2016

(54) CONTAINER ASSEMBLY

(75) Inventors: Mark Bensman, Rosh Ha'Ayin (IL); Zvika Fraiman, Havazelet Hasharon (IL)

(73) Assignee: THE STANLEY WORKS ISRAEL LTD., Rosh Ha'Ayin (IL)

( * ) Notice: Subject to any disclaimer, the term of this patent is extended or adjusted under 35 U.S.C. 154(b) by 11 days.

(21) Appl. No.: 12/897,490

(22) Filed: Oct. 4, 2010

(65) Prior Publication Data

US 2012/0080432 A1 Apr. 5, 2012

(51) Int. Cl.

| | |
|---|---|
| ***B65D 25/02*** | (2006.01) |
| ***B65D 25/28*** | (2006.01) |
| ***B25H 3/02*** | (2006.01) |
| *B65D 6/24* | (2006.01) |

(52) U.S. Cl.

CPC ..... *B25H 3/023* (2013.01); *B65D 25/02* (2013.01); *B65D 25/28* (2013.01)

(58) Field of Classification Search

CPC ..... B25H 3/023
USPC ..... 220/318, 528, 527, 523, 4.27, 756
See application file for complete search history.

(56) References Cited

U.S. PATENT DOCUMENTS

| | | | | | |
|---|---|---|---|---|---|
| 3,144,016 | A | * | 8/1964 | Basci | 126/265 |
| 3,612,335 | A | * | 10/1971 | Schurman | 220/324 |
| 3,960,289 | A | | 6/1976 | Panicci | |
| 4,122,925 | A | | 10/1978 | Schultheiss | |
| 4,476,994 | A | * | 10/1984 | Hope et al. | 220/318 |
| 4,541,539 | A | | 9/1985 | Matthews | |
| 4,619,363 | A | * | 10/1986 | Wolfseder | 206/373 |
| 4,760,921 | A | * | 8/1988 | Licari | 206/504 |
| 5,004,105 | A | | 4/1991 | Freadman | |
| 5,011,013 | A | | 4/1991 | Meisner et al. | |
| 5,169,018 | A | * | 12/1992 | Fiore | 220/318 |
| 5,176,281 | A | | 1/1993 | Fiore | |
| 5,244,265 | A | | 9/1993 | Chiang | |
| 5,439,108 | A | * | 8/1995 | Lackie | 206/373 |
| 5,447,252 | A | * | 9/1995 | Ward | 220/756 |
| 5,680,932 | A | | 10/1997 | Dickinson et al. | |
| 5,772,066 | A | | 6/1998 | Reynolds | |
| 5,803,254 | A | | 9/1998 | Vasudeva | |

(Continued)

OTHER PUBLICATIONS

Search Report and Search Opinion as issued for European Patent Application No. 11179718.9, dated Dec. 21, 2012.

(Continued)

*Primary Examiner* — J. Gregory Pickett
*Assistant Examiner* — Niki M Eloshway
(74) *Attorney, Agent, or Firm* — Pillsbury Winthrop Shaw Pittman LLP

(57) ABSTRACT

A container system having a base unit and a removable container unit. The base unit includes a base container portion and a base handle having a first end portion attached to at least one of the opposing side walls of the base container portion, a second end portion attached to at least another of the opposing side walls of the base container portion, and an extending portion extending between the first end portion and the second end portion. The base unit also includes a first latch region. The removable container unit includes a second latch region constructed and arranged to latch with the first latch region. The removable container unit prevents access to the opening of the base unit when the removable container unit is attached to the base unit and permits access to the opening of the base unit when the removable container unit is removed from the base unit.

19 Claims, 12 Drawing Sheets

(56) References Cited

U.S. PATENT DOCUMENTS

| | | | | |
|---|---|---|---|---|
| 5,826,718 | A | 10/1998 | Ahern, Jr. et al. | |
| 5,833,065 | A | 11/1998 | Burgess | |
| 5,882,097 | A | 3/1999 | Kohagen et al. | |
| 5,887,715 | A | 3/1999 | Vasudeva | |
| 5,971,200 | A | 10/1999 | Reynolds | |
| 6,176,559 | B1 | 1/2001 | Tiramani et al. | |
| 6,347,847 | B1 | 2/2002 | Tiramani et al. | |
| 6,371,320 | B2 * | 4/2002 | Sagol | 220/4.27 |
| D462,168 | S | 9/2002 | Klemmensen et al. | |
| 6,626,295 | B1 | 9/2003 | Vasudeva | |
| 6,637,592 | B1 | 10/2003 | Lai | |
| 6,761,366 | B1 | 7/2004 | Klemmensen et al. | |
| D496,531 | S | 9/2004 | Einav et al. | |
| 6,991,104 | B2 | 1/2006 | Redzisz | |
| 7,246,718 | B2 | 7/2007 | Einav et al. | |
| 7,314,134 | B2 | 1/2008 | Redzisz | |
| 7,334,680 | B2 | 2/2008 | Cunningham et al. | |
| 7,401,698 | B2 * | 7/2008 | Dost et al. | 206/349 |
| 7,503,569 | B2 | 3/2009 | Duvigneau | |
| 7,523,827 | B2 * | 4/2009 | Dane et al. | 206/503 |
| 2004/0178100 | A1 | 9/2004 | Ho | |
| 2006/0011502 | A1 | 1/2006 | Redzisz | |
| 2007/0012694 | A1 * | 1/2007 | Duvigneau | 220/4.27 |
| 2007/0056868 | A1 | 3/2007 | Godshaw et al. | |
| 2007/0164021 | A1 | 7/2007 | Nobel | |
| 2008/0067095 | A1 | 3/2008 | Mueller | |
| 2008/0121630 | A1 * | 5/2008 | Simard | 219/387 |
| 2008/0128305 | A1 | 6/2008 | Guirlinger | |
| 2008/0314795 | A1 | 12/2008 | Lin | |
| 2009/0008281 | A1 | 1/2009 | Williams et al. | |
| 2010/0012538 | A1 | 1/2010 | Brunner | |
| 2010/0052276 | A1 * | 3/2010 | Brunner | 280/47.35 |

OTHER PUBLICATIONS

Extended Search Report, including the Search Opinion, as issued for European Patent Application No. 13191939.1, dated Feb. 13, 2014.

* cited by examiner

CONTAINER ASSEMBLY

FIELD OF THE INVENTION

The present invention relates to a storage system with a removable container.

BACKGROUND OF THE INVENTION

Numerous container storage systems are known in the art. However, there is a constant need in the industry to improve upon existing container storage systems by making them more efficient, easy to use, modular, and/or multifunctional.

SUMMARY OF THE INVENTION

One aspect provides a container system having a base unit and a removable container unit. The base unit includes a base container portion having walls, including at least a first pair of opposing side walls and a second pair of opposing side walls. The side walls define an opening into an interior space in which articles to be transported can be stored. The base unit also includes a base handle having a first end portion attached to at least one of the opposing side walls, a second end portion attached to at least another one of the opposing side walls, and an extending portion extending between the first end portion and the second end portion. The base unit also includes a first latch region. The removable container unit is constructed and arranged to be removably attached to the base unit. The removable container unit prevents access to the opening of the base unit when the removable container unit is attached to the base unit and permits access to the opening of the base unit when the removable container unit is removed from the base unit. The removable container unit includes a removable container portion having a storage space for storing items and a cover movable between an open condition permitting access to the storage space and a closed condition preventing access to the storage space. The removable container unit also includes a second latch region constructed and arranged to latch with the first latch region, wherein the container unit is removable from the base unit when the first latch region is unlatched with the second latch region.

Another aspect provides a container system having a base unit and a removable container unit. The base unit includes a base container portion having walls, including at least a first pair of opposing side walls and a second pair of opposing side walls. The side walls define an opening into an interior space in which articles to be transported can be stored, ii) a base handle, and iii) a first latch region. The removable container unit is constructed and arranged to be removably attached to the base unit. The removable container unit prevents access to the opening of the base unit when the removable container unit is attached to the base unit and permits access to the opening of the base unit when the removable container unit is removed from the base unit. The removable container unit includes a removable container portion having a storage space for storing items and a cover movable between an open condition permitting access to the storage space and a closed condition preventing access to the storage space. The removable container unit also includes a container handle to facilitate transport of the container unit separately from the base unit. The removable container unit also includes a second latch region constructed and arranged to latch with the first latch region. The container unit is removable from the base unit when the first latch region is unlatched with the second latch region. The container handle is positioned so as to be on a vertical side surface of the container system when the second latch region is latched with the first latch region and forms a top carrying handle for the removable container unit when the removable container unit is removed from the base unit.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
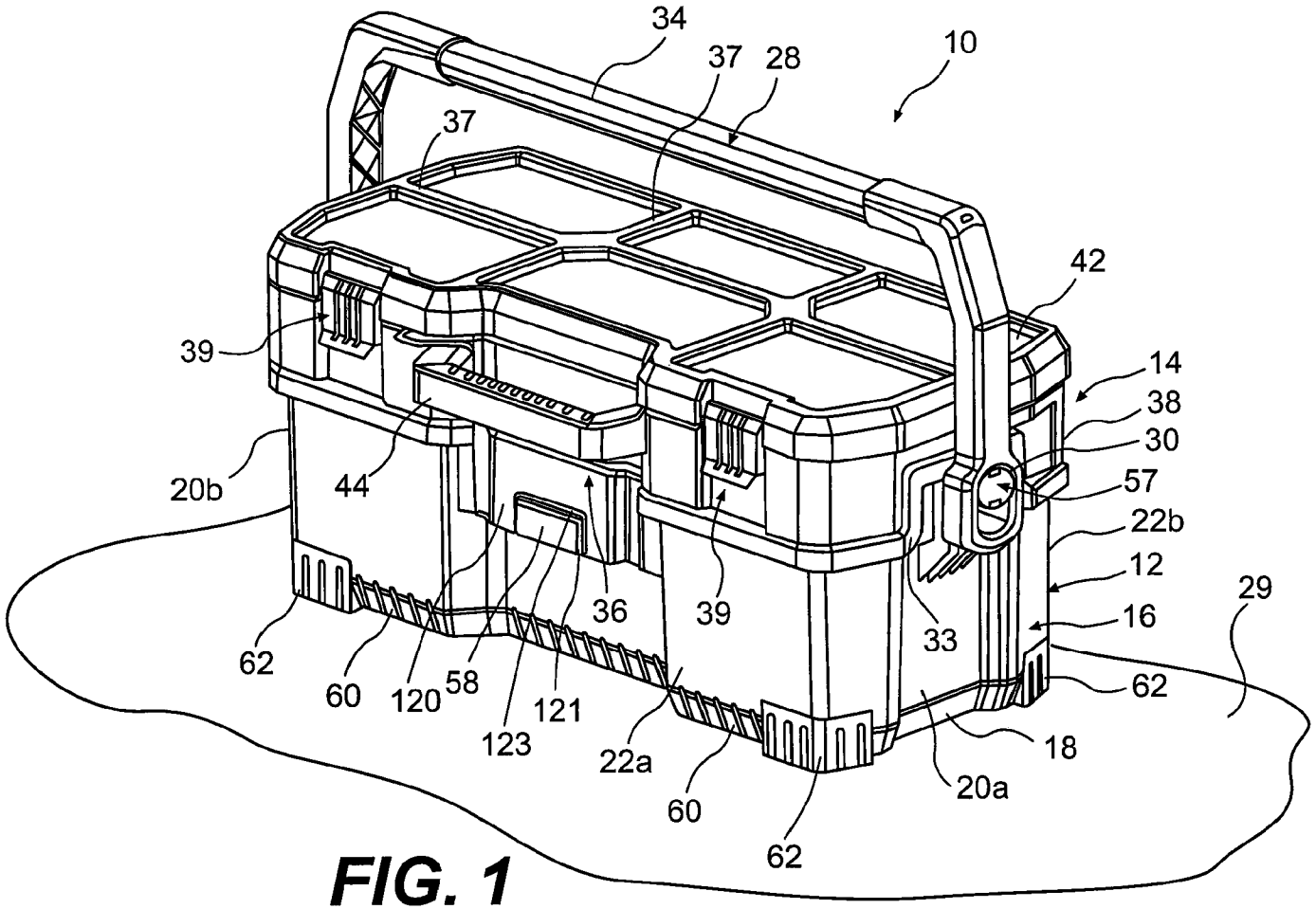
FIG. 1 is a perspective view of a container system in accordance with an embodiment of the present invention.

FIG. 1 shows a container system 10 including a base unit 12 and a removable container unit 14. The base unit 12 includes a base container portion 16 having walls or sides, including at least a first pair of opposing side walls or sides 20*a*, 20*b* and a second pair of opposing side walls or sides 22*a*, 22*b*. The side walls 20*a*, 20*b*, 22*a*, 22*b* define an opening 24 (see FIG. 3) into an interior space 26 (see FIG. 3) in which articles to be transported can be stored. The base unit 12 may also be provided with a bottom wall or side 18. In some embodiments, the bottom wall 18 of the base unit 12 may be eliminated and may be replaced by a portion of another container system 10 removably coupled to the first pair of side walls 20*a*, 20*b*, and second pair of side walls 22*a*, 22*b*. The base unit 12 also includes a base handle 28 having a first end portion 30 attached to one of the first pair of opposing side walls 20*a*, 20*b*, a second end portion 32 (see FIG. 3) attached to the other of the first pair of opposing side walls 20*a*, 20*b*, and an extending portion 34 extending between the first end portion 30 and the second end portion 32. The extending portion 34 may traverse at least a portion of the opening 24 of the base unit 12. Although the illustrated embodiment shows the base handle 28 having the first end portion 30 attached to one of the side walls 20*a*, 20*b*, and the second end portion 32 attached to the other of the first pair of side walls 20*b*, it is contemplated that the first end portion 30 does not necessarily need to be attached to only one of the side walls 20*a* and the second end portion 32 does not necessarily need to be attached only to the other of the first pair of opposing side walls 20*a*, 20*b*. For example, the first end portion 30 of the base handle 28 may be attached to a corner between one of the first pair of opposing side walls 20*a*, 20*b* and one of the second pair of opposing side walls 22*a*, 22*b*. The second end portion 32 may be attached to a corner between the other of the first pair of opposing side walls 20*a*, 20*b* and the other of the second pair of opposing side walls 22*a*, 22*b*. The base handle 28 may also be attached to other locations.

The base unit 12 also includes a first latch region 36. The removable container unit 14 is constructed and arranged to be removably attached to the base unit 12. The removable container unit 14 prevents access to the opening 24 of the base unit 12 when the removable container unit 14 is attached to the base unit 12 (see FIGS. 1 and 2) and permits access to the opening 24 of the base unit 12 when the removable container unit 14 is removed from the base unit 12 (see FIG. 3). It is contemplated that the removable container unit 14 does not necessarily need to completely prevent access to the interior space 26 when the removable container unit 14 is attached to the base unit 12. That is, in some embodiments, the removable container unit 14 may only partially cover the opening 24 such that access to the interior space 26 is only partially prevented. Alternatively, the removable container unit 14 may completely cover the opening 24 such that access to the interior space 26 is completely prevented. Accordingly, the removable container unit 14 may prevent access to the interior space 26, including either completely preventing access or partially preventing access thereto. The base unit 12 and the removable container unit 14 may be made of molded plastic. However, it is contemplated the base unit 12 and the removable container unit 14 may include wood, metal, rubber, other materials, or a combination thereof. Any combination of the first pair of side walls 20*a*, 20*b*, and second pair of side walls 22*a*, 22*b* may be made of various materials. The first pair of side walls 20*a*, 20*b*, and second pair of side walls 22*a*, 22*b* do not necessarily need to be rigid. For example, it is contemplated that any combination of the first pair of side walls 20*a*, 20*b*, and second pair of side walls 22*a*, 22*b* ,l or other parts of the container system 10 may be made of a fabric material (e.g., cloth, denim) or flexible materials.

Figure 2:
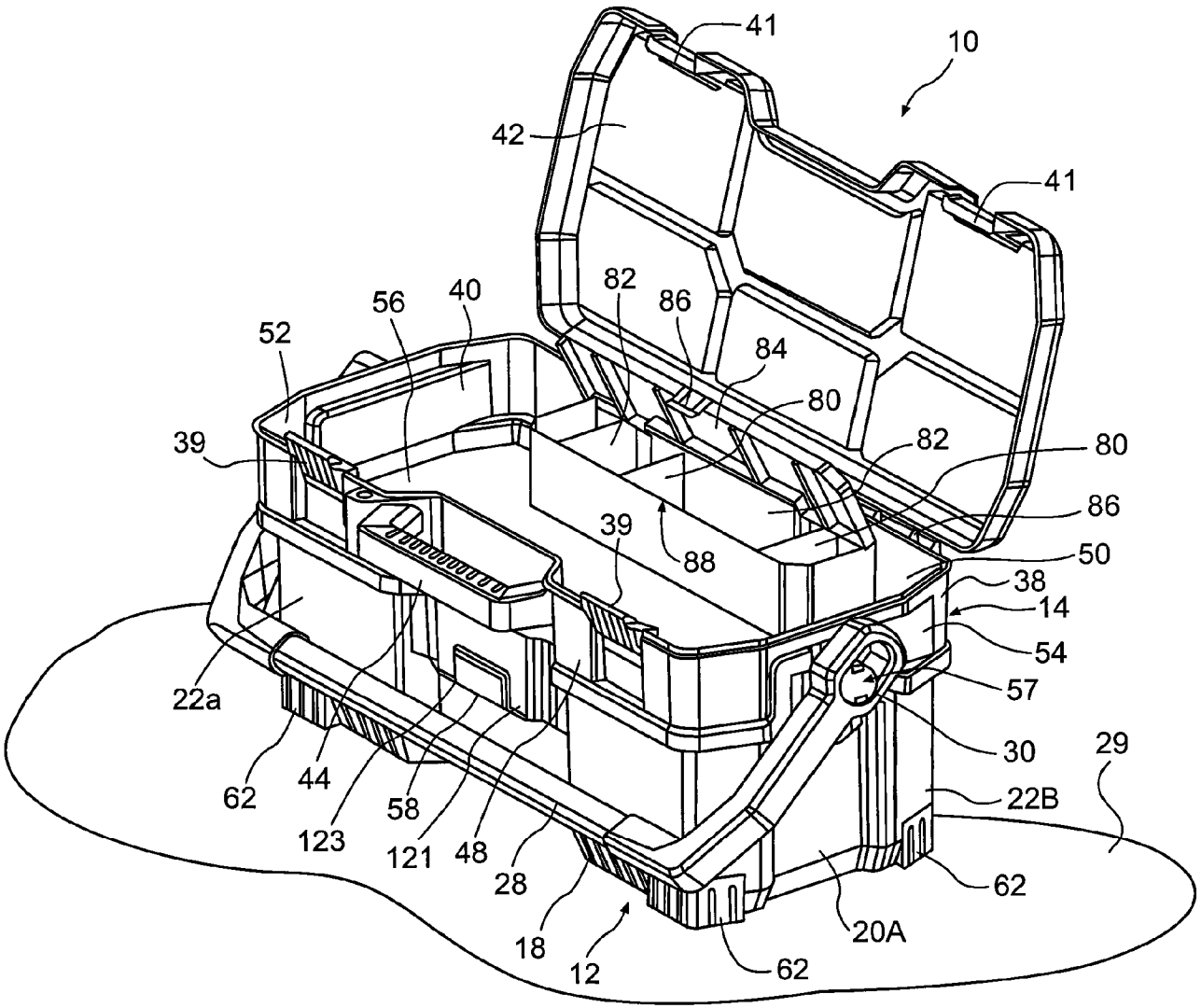
FIG. 2 is a perspective view of the container system in accordance with the embodiment shown in FIG. 1.

As shown in the embodiment of FIG. 2, the removable container unit 14 includes a removable container portion 38 having an opening 11 into a storage space 40 for storing items. The removable container unit 14 also includes a cover 42 movable between an open condition permitting access to the storage space 40 and a closed condition (see FIG. 1) preventing access to the storage space 40. The cover 42, in the closed condition, may completely cover the opening 11 so as to completely prevent access to the storage space 40. Alternatively, in some embodiments, the cover 42, in the closed condition, may only partially cover the opening 11 so as to partially prevent access to the storage space 40. Thus, the cover 42, in the closed condition, may prevent access to the storage space 40, including either completely preventing access or partially preventing access thereto. The cover 42 may be provided with ridges 37 (see FIG. 1) constructed and arranged to provide rigidity, aesthetics, and/or support for the cover 42. In some embodiments, the cover 42 is removable from the container unit 12.

Figure 5:
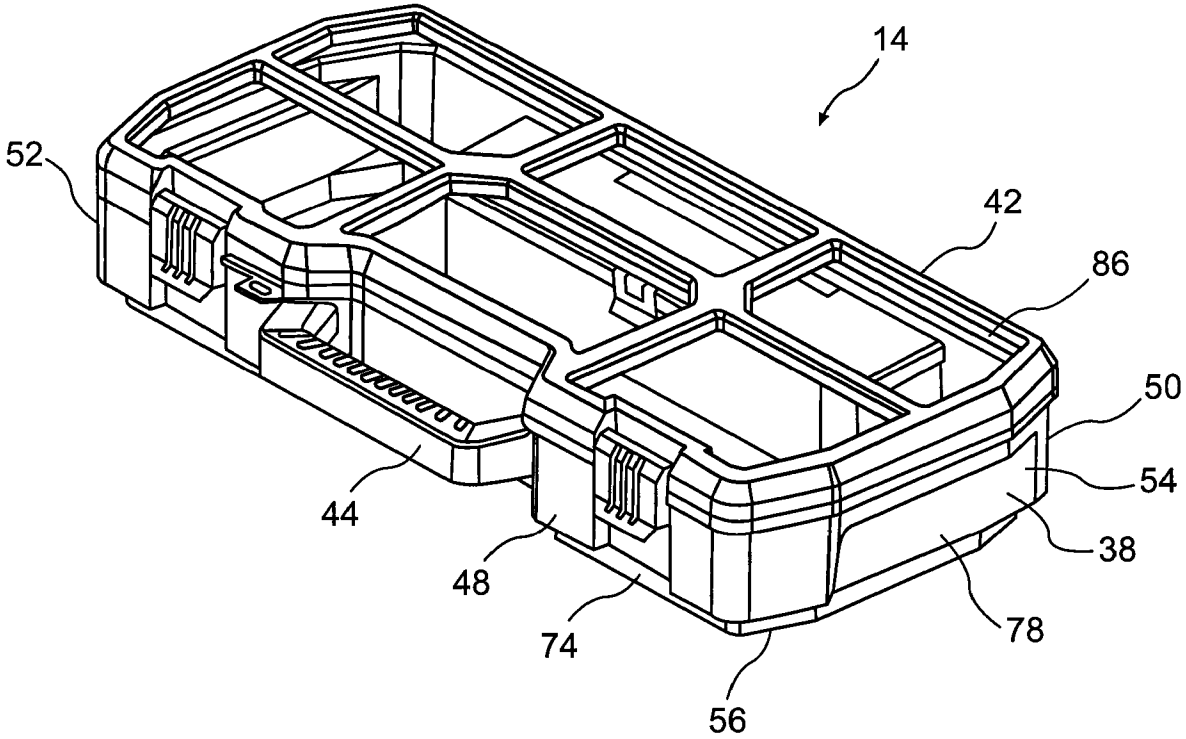
FIG. 5 is a perspective view of a removable container unit of the container system in accordance with an embodiment.
Figure 6:
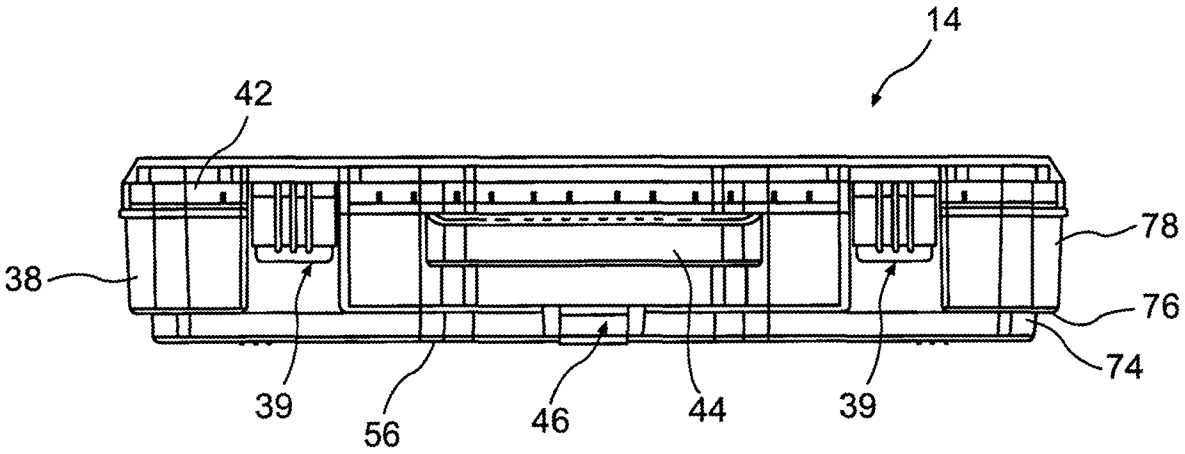
FIG. 6 is a front view of the removable container unit of the container system in accordance with an embodiment.

As shown in FIG. 2, latches 39 (two are shown in this embodiment) may be provided to engage with latch engaging structures 41 of the container portion 38. In this embodiment, the latches 39 are pivotable to latch and unlatch the cover 42 to the container portion 38 when the cover 42 is in the closed condition, as shown in FIGS. 1 and 5. Alternatively, it is contemplated that the latches 39 may be provided on the cover 42 and the latch engaging structures 41 may be provided on the container portion 38. A container handle 44 is provided on the removable container unit 14 to facilitate transport of the container unit 14 separately from the base unit 12. The container handle 44 may be provided with rubber, foam or anti-friction material thereon to facilitate the grasping of the handle 44. The removable container unit 14 also includes a second latch region 46 (see FIG. 6) constructed and arranged to latch with the first latch region 36. The container unit 14 is removable from the base unit 12 when the first latch region 36 is unlatched with the second latch region 46. The base unit 12 may also include a latch region 66 and a latch region 68 constructed and arranged to engage with a latch region 70 (see FIG. 10) and a latch region 72 (see FIG. 10), respectively, on the removable container unit 14. These latch regions 66, 68, 70, and 72 will be described in more detail later. In some embodiments, the latch region 66 may be considered a third latch region and the latch region 70 may be considered a fourth latch region.

The base unit 12 may include an actuating member 58 (see FIG. 2) constructed and arranged to be actuated to unlatch the first latch region 36 from the second latch region 46. It is contemplated that in some embodiments, the actuating member 58 may be located at other locations on the base unit 12 or may be located on the container unit 14.

In the embodiment of FIG. 2, the container portion 38 of the removable container unit 14 includes a front wall or side 48, a back wall or side 50, two opposing side walls or sides 52, 54, and a bottom wall or side 56 (see FIG. 5). The container handle 44 is positioned so as to be on a vertical side surface of the container system 10 when the second latch region 46 is latched with the first latch region 36. In one embodiment, the actuating member 58 of the latch region 36 may also be located on the same vertical side surface of the container system 10. This vertical side surface of the container system 10 may be defined by the front wall 48 of the container unit 14 and the side wall 22*a* of the base unit 12. The container handle 44 may form a top (upper) carrying handle for the removable container unit 14 when the removable container unit 14 is removed from the base unit 12.

In one embodiment, the base handle 28 may be attached to extending portions 33, 35 (see FIG. 3) of the base unit 12. The first end portion 30 may be connected to extending portion 33 and the second end portion 32 may be connected to extending portion 35. In one embodiment, the base handle 28 is pivotable between an upright position (see FIG. 1) and a lowered position (see FIG. 2). The base handle 28 may include locking structures 57 that enable the base handle 28 to be moved between a locked position, preventing rotation of the base handle 28 from the upright position to the lowered position, and an unlocked position permitting rotation of the base handle 28 from the upright position to the lowered position. It is contemplated that the base handle 28 does not necessarily to be locked in the upright position as shown in FIG. 1 such that the handle 28 is substantially perpendicular (90 degrees) to a surface 29 on which the container system 10 is resting. Instead, in some embodiments, the base handle 28 may be locked at positions varying from this upright position. It is also contemplated that even in the locked position, the base handle 28 may have limited movement. For example, in some embodiments, the handle 28, in the locked position, may be moved up to 20 degrees from the upright position such that the handle 28 is at most 70 degrees (or 110 degrees) from the surface 29 on which the container system 10 is resting. The locking of the base handle 28 will be described in detail later. The base handle 28 may be made of any material and does not necessarily need to be rigid. For example, in some embodiments, the base handle 28 may be made of rope or other non-rigid materials.

Figure 7:
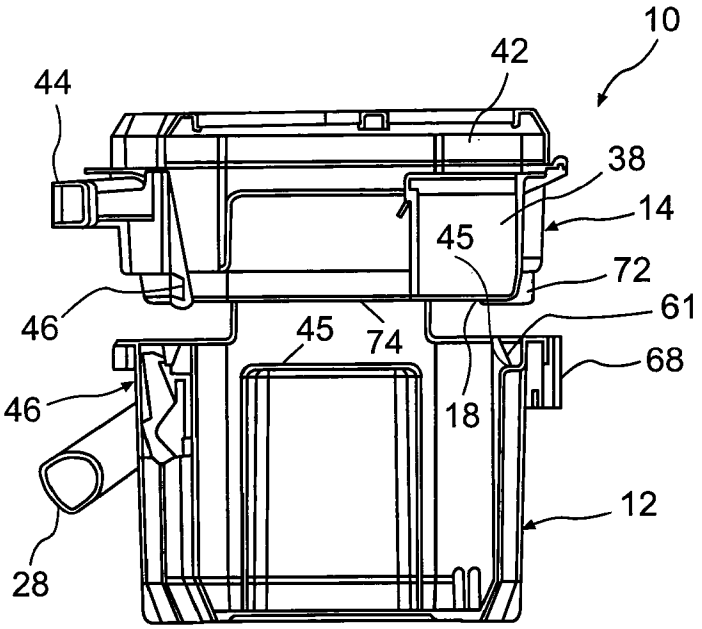
FIG. 7 is a partial-cross sectional side view of the container system in accordance with an embodiment.

In one embodiment, the removable container unit 14 may be removed from the base unit 12 only when the base handle 28 is in the lowered position and the removable container 14 is unlatched from the base unit 12, as shown in FIG. 7. In such embodiment, a lack of clearance between the base handle 28 and the removable container unit 14 prevents removal of container unit 14 when the handle 28 is in its raised position. However, it is contemplated that in other embodiments, the extending or elongated portion 34 of the handle 28 may be sufficiently spaced from the cover 42 of the container unit 14 when the handle 28 is in the upright position and the cover 42 is in the closed condition such that the container unit 14 may be removed from the base unit 12 when the handle 28 is in the upright position.

Figure 3:
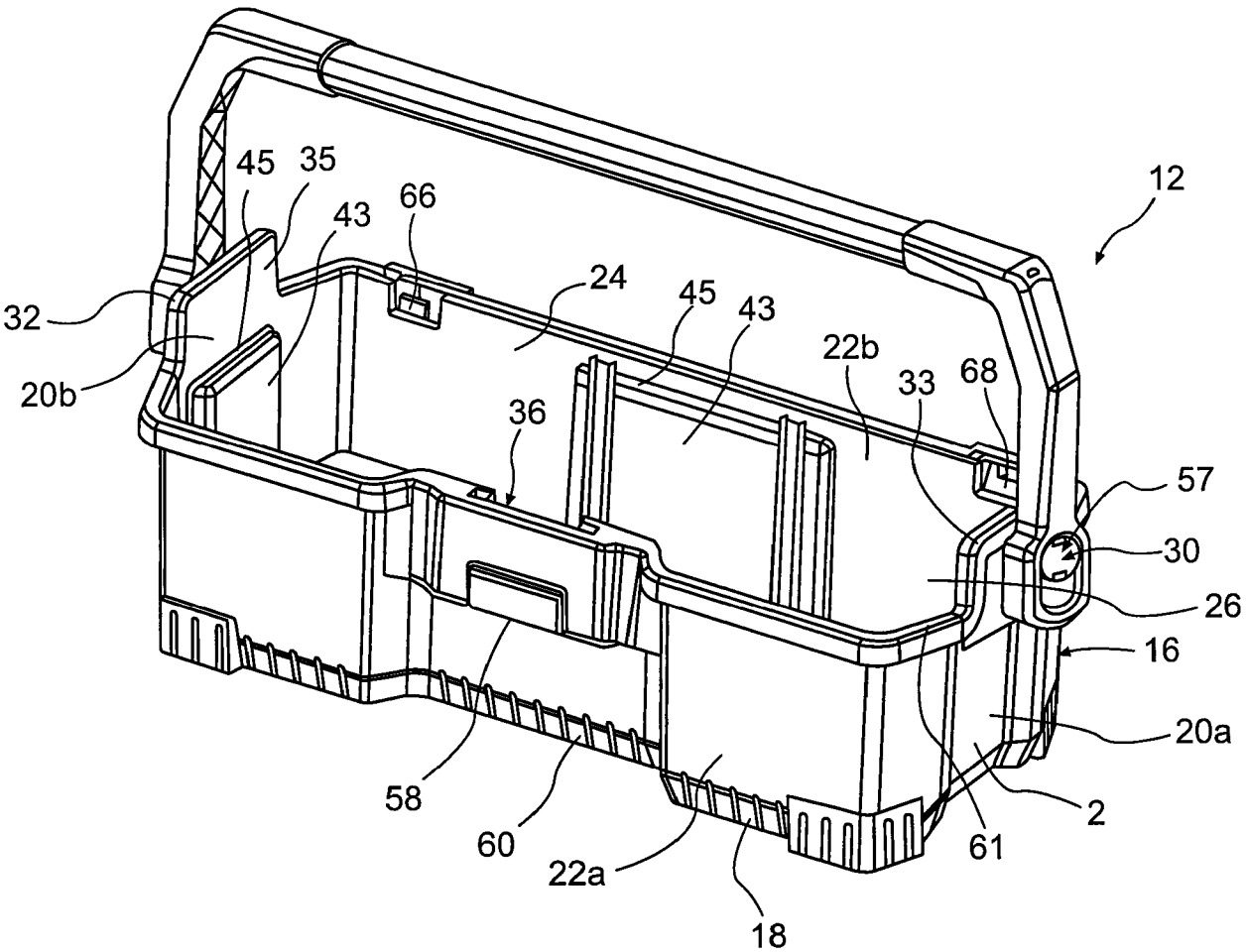
FIG. 3 is a perspective view of a base unit of the container system in accordance with an embodiment.
Figure 4:
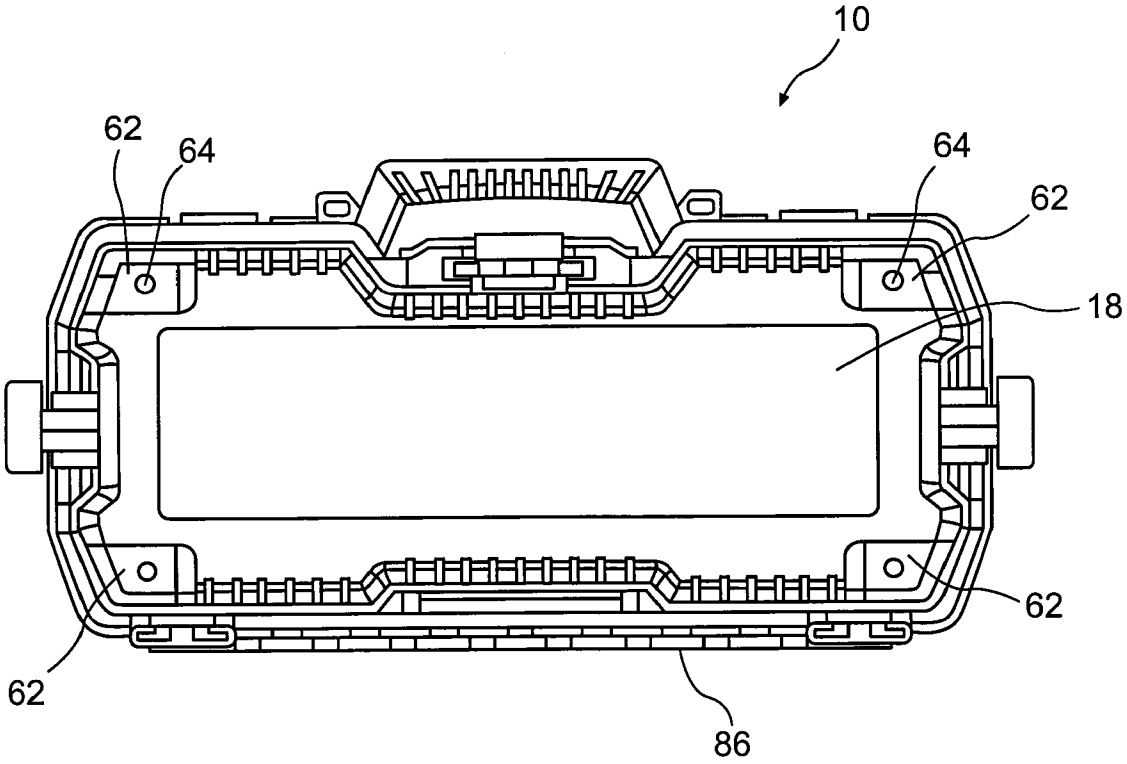
FIG. 4 is a bottom view of the container system in accordance with an embodiment.

As shown in FIG. 3, a rim 61 may be provided near or surrounding the opening 24 of the base unit 12 and may be constructed and arranged to contact at least a portion of the removable container unit 14 when the removable container unit 14 is attached to the base unit 12. As shown in FIG. 3, the base unit 12 may also optionally include at least one depression 43 provided on at least one of the side walls 20*a*, 20*b*, 22*a*, 22*b*, each of the depressions 43 forming a ledge 45. The ledges 45 may be constructed and arranged to contact at least a portion of bottom wall 56 of the container unit 14 when the container unit 14 is attached to the base unit 12. A plurality of ridges or recesses 60 may optionally be provided on a lower portion of the base unit 12. The ridges or recesses 60 may be provided for aesthetics and/or for adding rigidity to the container system 10. The base unit 12 may also be provided with feet 62 (four are shown in FIG. 4) constructed and arranged to contact a surface on which the base unit 12 is resting. Each of the feet 62 may be provided at lower corners of the base unit 12. That is, each of the feet 62 may be constructed and arranged to contact at least two side walls 20*a*, 20*b*, 22*a*, 22*b* of the base unit 12 and at least a portion of the bottom wall 18. The feet 62 may be attached to the base unit 12 via screws 64 (see FIG. 4), although other attachment mechanisms, such as, just for example, pins, adhesives, fastenings, bolts, interference fit, snap fit, may be used.

FIG. 5 shows the container unit 14 with the cover 42 in the closed condition in accordance with an embodiment. In one embodiment, the cover 42 is made of clear or translucent plastic. Alternatively, the cover 42 may be made of opaque materials. The cover 42 of the container unit 14 may be pivotably attached to the container portion 38 via hinges 86. The hinges 86 may include a stop structure (not shown) constructed and arranged to limit the range of pivotal movement of the cover 42. It is contemplated that in other embodiments, the cover 42 may be a snap-on cover, a sliding cover, an accordion type cover, or other types of covers. The container portion 38 of the container unit 14 may include a lower portion 74 having a perimeter smaller than that of an upper portion 78 of the container portion 38. In one embodiment, the container portion 38 has generally the same shape as the upper portion 78. As such, a ledge 76 (see FIG. 6) may be defined between the lower portion 74 and the upper portion 78. The ledge 76 may be constructed and arranged to abut against at least a portion of the rim 61 of the base unit 12 when the container unit 14 is attached to the base unit 12.

Referring back to FIG. 2, the storage space 40 of the container unit 14 may include a plurality of dividers 80 dividing the storage space 40 into compartments 82. At least one compartment lid 84 may be movable between an open condition permitting access to at least one of the compartments 82 and a closed condition preventing access to the at least one of the compartments 82. The compartment lid 84 may include a latch 86 constructed and arranged to engage with a latch engaging structure 88 on one of the dividers 80. It is contemplated that the location of the latch 86 and the latch engaging structure 88 may be interchangeable. It is also contemplated that the compartments 82 may have a variety of configurations and arrangements.

Figure 8:
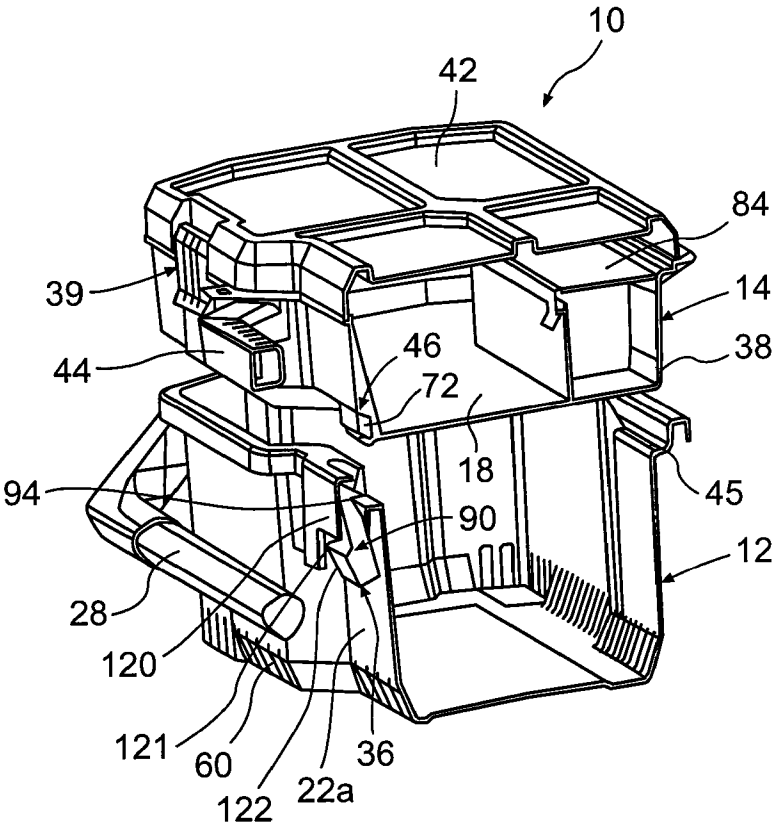
FIG. 8 is a cross-sectional perspective view of the container system in accordance with an embodiment.

FIG. 8 shows a cross sectional view of the container unit 14 being removed from the base unit 12. In this embodiment, the first latch region 36 includes a latch member 90 constructed and arranged to engage with the second latch region 46. The latch member 90 may be located between an outer wall 120 of the base unit 12 and the side wall 22*a* (e.g., the front wall 22*a*) of the base unit 12. The actuating member 58 may be formed on the latch member 90 and may be a part of the latch member 90, or the actuating member 58 may be a separate piece operatively connected to the latch member 90. The outer wall 120 may be constructed and arranged to be forwardly spaced from, and extend generally parallel, to the side wall 22*a* of the base unit 12. A cut-out 121 may be formed in the outer wall 120, and at least a portion of the actuating member 58 may be received in the cut-out 121. In one embodiment, the cut-out 121 includes a side or edge 123 (see FIG. 9*a*) located above the actuating member 58. The outer wall 120 and the side wall 22*a* of the base unit 12 may define a space 122 (see FIG. 9*a*) therebetween, wherein the latch member 90 is located within the space 122. In this embodiment, the latch member 90 includes the actuating member 58. However, it is contemplated that in other embodiments, the actuating member 58 may be separate from the latch member 90 and may be operatively connected to the latch member 90 to latch and unlatch the container unit 14 from the base unit 12. In one embodiment, the second latch region 46 has a latching engaging structure 47 that includes a latch engaging recess 92, constructed and arranged to receive at least a portion of the latch member 90. In this embodiment, the latch member 90 includes a latching portion 94, taking the form of a hook, that is constructed and arranged to be received in the latch engaging recess 92 of the container unit 14. It is contemplated that in other embodiments, the second latch region 46 may be defined by the latch member 90 and the first latch region 36 may be defined by the latch engaging recess 92. It is also contemplated that the number and location of the latch member 90 and latch engaging recess 92 may vary.

Figure 9C:
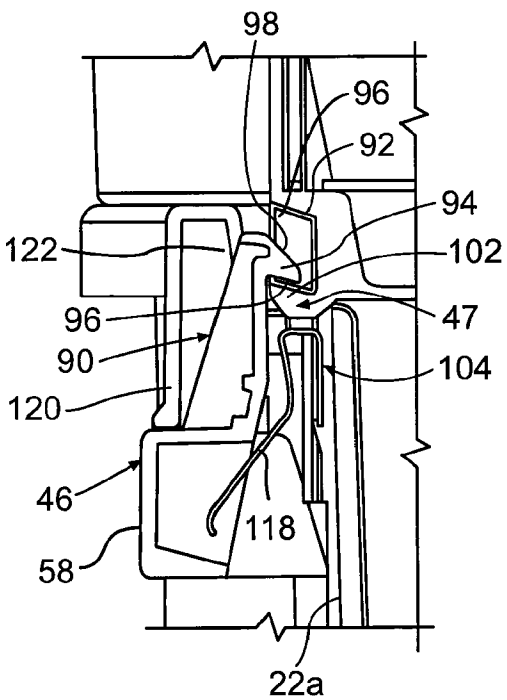
FIGS. 9*a*-9*c* are detailed views of a first latch region and a second latch region of the container system in accordance with an embodiment.
Figure 9B:
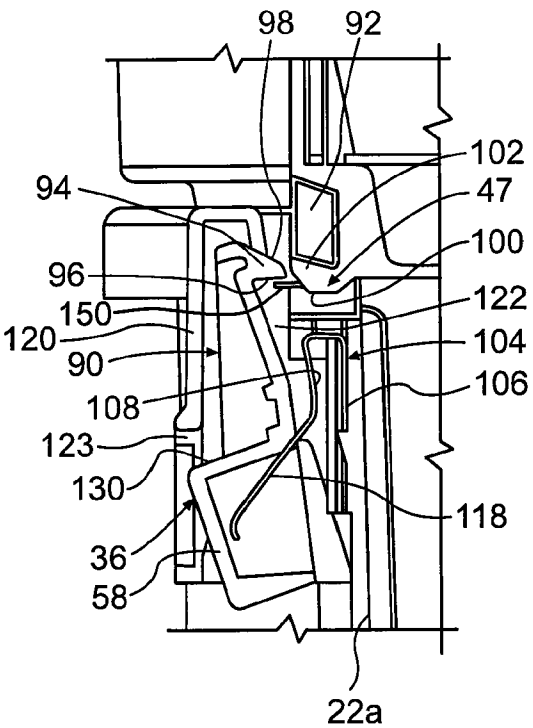
Figure 9A:
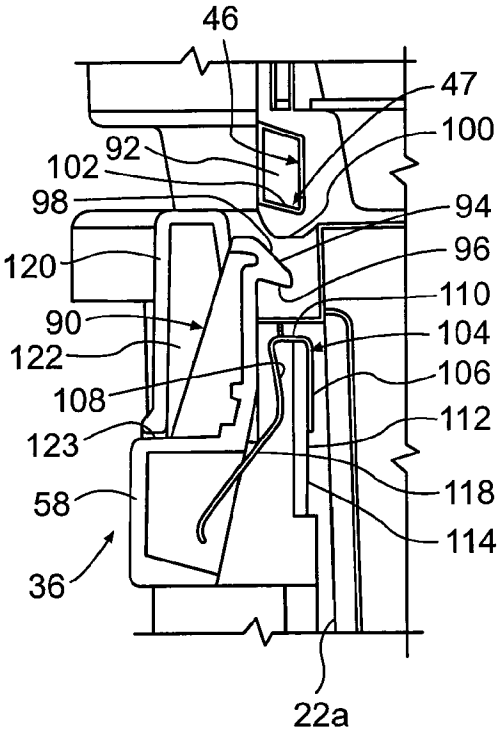

As shown in FIG. 9*a*, the latching portion 94 of the base unit 12 includes a first contact surface 96 and a sliding surface 98. The latch member 90 of the first latch region 36 is operatively connected to a spring 104, taking the form of a leaf spring in this embodiment. The spring 104 may be located between the latch member 90 and the side wall 22*a* of the base unit 12. The spring 104 may be configured to bias the latch member 90 in an unactuated, default position, as shown in FIG. 9*a*. In the illustrated embodiment, the spring 104 includes a first leg 106, a second leg 108, and an extending leg 118. The first leg 106 and the second leg 108 are connected via a connecting member 110 extending therebetween. In this embodiment, the second leg 108 is connected to and may be integral with the extending leg 118 that extends away from the base unit 12 and towards the latching member 90. The first leg 106 of the spring 104 is connected to the base unit 12 via a protrusion 112 in the base unit 12 that is received in an opening 114 in the first leg 106. However, it is contemplated that the spring 104 may be connected to the base unit 12 via adhesives, screws, pins, fastenings, or other attachment mechanisms. The spring 104 may also have other configurations. The latch member 90 may be pivotably attached to at least a portion of the base unit 12 via pins or other attachment mechanisms. Alternatively or additionally, the latch member 90 may be connected to at least a portion of the spring 104. In the illustrated embodiment, the latch member 90 contacts at least a portion of the extending leg 118 of the spring 104. The extending leg 118 may be constructed and arranged to flex and move towards the side wall 22*a* of the base unit 12 when the latch member 90 is being inserted into or removed from the latch engaging recess 92, which will be described in more detail later. In one embodiment, the latch member 90 includes a top surface 130 constructed and arranged to abut against the side 123 of the inner wall 120 when the latch member 90 is in the unactuated position.

In the illustrated embodiment, the latch engaging structure 47 of the second latch region 46 of the container unit 14 includes the latch engaging recess 92 and a camming surface 100. The camming surface 100 is constructed and arranged to cam against the sliding surface 98 of the latch member 90. A second contact surface 102 of the container unit 14 is provided in proximity to the latch engaging recess 92 and partially defines the latch engaging recess 92. The second contact surface 102 is constructed and arranged to contact the first contact surface 96 of the latch member 90 when the latch member 90 is in the latched position, wherein the latch member 90 is received in the latch engaging recess 92 to latch the container unit 14 to the base unit 12, as shown in FIG. 11*a*.

Figure 10:
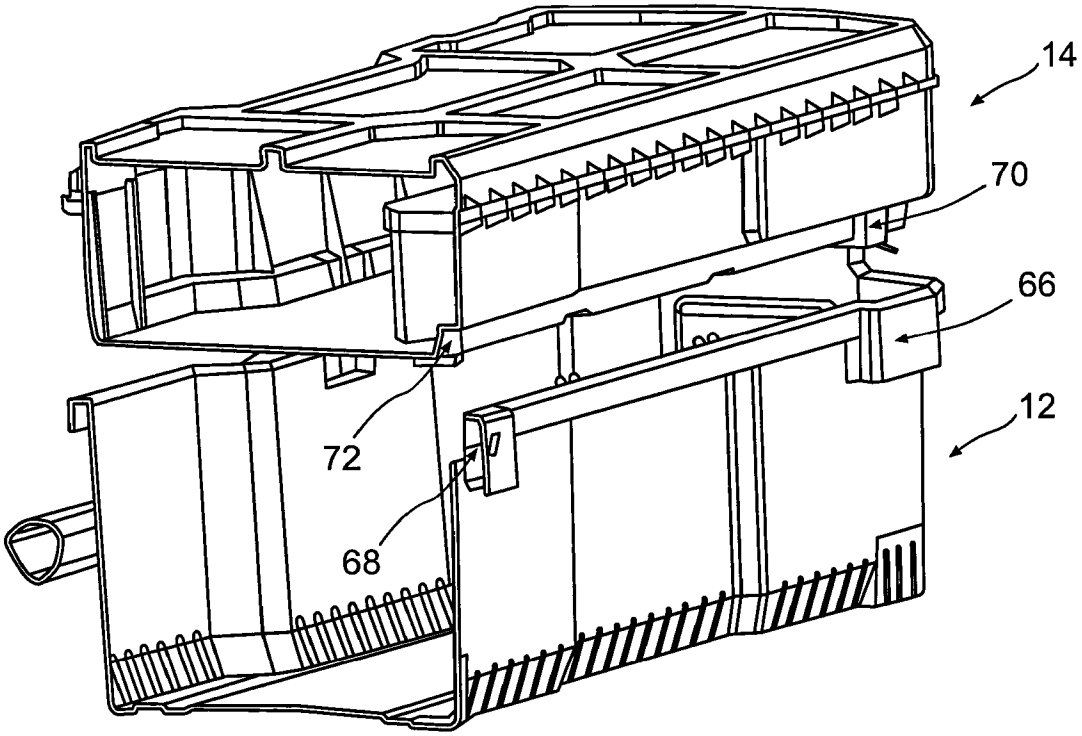
FIG. 10 is a cross-sectional perspective rear view of the container system in accordance with an embodiment.

FIG. 10 shows a rear cross sectional view of the container system 10. As shown in this embodiment, the container unit 14 also contains the latch regions 70, 72 that are constructed and arranged to engage with the latch regions 66, 68, respectively, of the base unit 12.

Figure 11C:
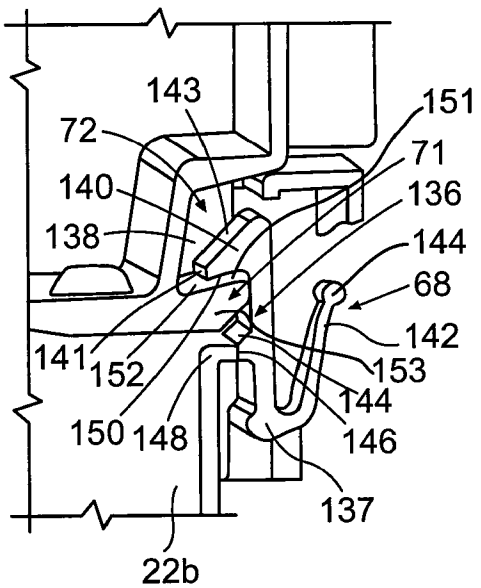
FIG. 11*a*-11*c* are detailed views of a third latch region and fourth latch region of the container system in accordance with an embodiment.
Figure 11B:
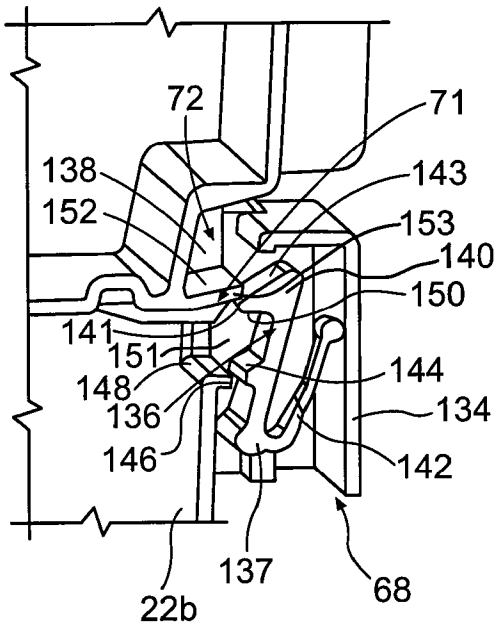
Figure 11A:
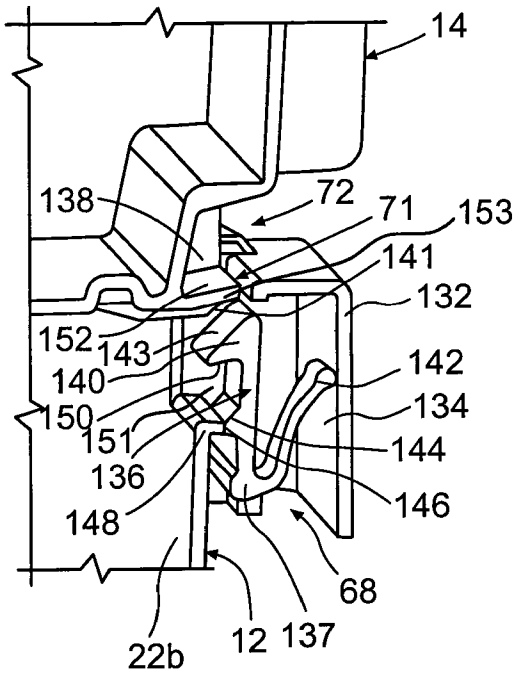

FIG. 11*a* shows a detailed view of the latch region 72 of the container unit 14 and the latch region 68 of the base unit 12. In this embodiment, the latch region 68 of the base unit 12 includes a latch member 136. The base unit 12 includes a rear outer wall 132 constructed and arranged to extend generally parallel to the side wall 22*b* of the base unit 12. The rear outer wall 132 and the side wall 22*b* define a space 134 in which the rear latch member 136 is located. The rear latch member 136 may be pivotably attached to the base unit 12. The rear latch member 136 may be attached to the base unit 12 via a ball and socket structure, or may be attached via other mechanisms. In one embodiment, the rear latch member 136 includes a rotating portion 137 constructed and arranged to be received in a portion (not shown) of the base unit 12 so as to form a rotatable connection that enables the latch member 136 to pivot along the rotating portion 137.

In this embodiment, the latch region 72 has a rear latch engaging structure 71 that includes a latch engaging recess 138, constructed and arranged to receive a latching portion 140 of the latch member 136. The latch member 136 may have resilient properties that enables the latch member 136 to function as a leaf spring. The latch member 136 may include an extension portion 142 constructed and arranged to contact the rear outer wall 132 of the base unit 12. The extension portion 142 may be constructed and arranged to flex against the rear outer wall 132 when the latch member 90 is being inserted into or removed from the latching engaging recess 138, as shown in FIG. 11*b* and which will be described in more detail later.

In the unactuated, default position, as shown in FIG. 11*a*, a first side contact portion 144 of the latch member 136 may contact a second side contact portion 146 of the base unit 12. The second side contact portion 146 may be part of a protrusion 148 that extends from the side wall 22*b* of the base unit 12. The latching portion 140 may also include a first contact surface 150 constructed and arranged to abut against a second contact surface 152 of the container unit 14. The first contact surface 150 of the latching portion 140 may be formed near a groove 151 of the latch member 136. The second contact surface 152 of the container unit 14 may be formed on an extending portion 153 of the container unit 14. The extending portion 153 of the container unit 14 may be constructed and arranged to be received in the groove 151 of the latch member 136 when the latch region 68 is latched with the latch region 72. The second contact surface 152 of the container unit 14 may be in proximity to the latch engaging recess 138 and may partially define the latch engaging recess 138. The latch engaging structure 71 of the latch region 72 may also include a camming portion 141 constructed and arranged to contact a sliding portion 143 of the latch member 136 when the container unit 14 is being attached to the base unit 12. Either one or both the camming portion 141 and the sliding portion 143 may be slanted or sloped. However, it should be appreciated that the camming portion 141 and/or the sliding portion 143 may have other configurations. For example, the camming portion 141 may have a pointed configuration rather than the sloped configuration as shown in FIG. 11*a*.

The latch region 70 of the container unit 14 may have a similar configuration as the latch region 72 of the container unit 14, and the latch region 66 of the base unit 12 may have a similar configuration as the latch region 72 of the base unit 12. It is contemplated that the configuration of the latch region 72 and latch region 68 may be interchangeable. Accordingly, the configuration of the latch region 70 and the latch region 66 may also be interchangeable. For example, the latch region 68 of the base unit 12 may include the latch engaging recess 138, and the latch region 72 of the container unit 14 may include the latch member 136.

Operation of the latch regions 36, 66, and 68 of the base unit 12 and the latch regions 46, 70, and 72 of the container unit 14 to latch and unlatch the container unit 14 from the base unit 12 in accordance with an embodiment will be described below with reference to FIGS. 9*a*-9*c*, 11*a*-11*c*. To attach the container unit 14 to the base unit 12, the handle 28 may be moved to the lowered position and the container unit 14 may be positioned above the base unit 12, as shown in FIGS. 7, 8, and 10, thus aligning the latch region 46 with latch region 36, latch region 66 with latch region 70, and latch region 68 with latch region 72. In this embodiment, to attach the container unit 14 to the base unit 12, the latch region 46 should be engaged with latch region 36, latch region 66 should be engaged with latch region 70, and latch region 68 should be engaged with latch region 72.

The operation of engaging latch region 46 with latch region 36 will be described with respect to FIGS. 9*a*-9*c*. As shown in FIG. 9*a*, the latch member 90 of the latch region 36 is in the default, unactuated position, and the latch region 46 may be aligned with latch region 36 and pushed towards latch region 36. In this unactuated position, at least a portion of the camming surface 100 of the latch region 46 is disposed above at least a portion of the sliding surface 98 of the latch member 90. The first latch region 36 and the second latch region 46 can be latched either manually or automatically. As used herein, "manually" latched means additional actuation or action by a user to latch components of the container system 10, separate from the pushing or pulling of the removable container unit 14 by the user to or from the base unit 12. In contrast, "automatically" latched means latching of components of the container system 10 by action generated in response to or effected by the pushing or pulling of the removable container unit 14 to or from the base unit 12 by the user.

In one embodiment, the first latch region 36 and the second latch region 46 may be manually latched as follows. The actuating member 58 may be manually actuated by a user against the bias of the spring 104 to pivot the latch member 90 in the clockwise direction to the actuated position, as shown in FIG. 9*b*. In this position, the latching portion 94 is positioned to the left of the latch engaging recess 92 and the sliding surface 98 is positioned to the left of the camming surface 100, thereby enabling the removable container unit 14 to be disposed on the base unit 12, as shown in FIG. 9*b*. In this embodiment, at least a portion of the bottom wall 56 of the removable container unit 14 may be disposed against at least a portion of the base unit 12. After the container unit 14 has been placed on the base unit 12, the actuating member 58 may be released by the user, thus enabling the spring 104 to snap the latch member 90 back to the unactuated position, whereby the first contact surface 96 of the latch member 90 is moved above the second contact surface 102 of the latch region 46 until the latching portion 94 of the latch member 90 is received in the latch engaging recess 92 of the latch region 46, as shown in FIG. 9*c*. Accordingly, the container unit 14 is latched to the base unit 12 via latch region 46 and latch region 36.

Alternatively or additionally, the first latch engaging region 36 and the second latch engaging region 46 may be automatically latched as follows in accordance with an embodiment. The camming surface 100 and the sliding surface 98 may be used to engage the latch region 46 with the latch region 36. For example, when the container unit 14 is in the position relative to the base unit 12 as shown in FIG. 9*a*, the container unit 14 may be pushed towards the base unit 12 so that the camming surface 100 of the latch region 46 is pushed against the sliding surface 98 of the latch member 90. The downward movement of the camming surface 100 against the sliding surface 98 of the latch member 90 may push the latch member 90 in the counterclockwise direction against the bias of the spring 104. The latch member 90 may be rotated in the counterclockwise direction and the container unit 14 may be lowered onto the base unit 12 until the latching engaging recess 92 of the latch region 46 is aligned with the latching portion 94 of the latch member 90, whereupon the spring 104 snaps the latching portion 94 of the latch member 90 in the clockwise direction towards the latch engaging recess 92. When the latch engaging recess 92 is aligned with the latching portion 94 of the latch member 90, the first contact surface 96 may be aligned with the second contact surface 102, thus enabling the first contact surface 96 to slide against the second contact surface 102 so that the latching portion 94 is received in the latch engaging recess 92, as shown in FIG. 9*c*. In the position shown in FIG. 9*c*, the latch region 46 of the container unit 14 is latched with the latch region 36 of the base unit 12.

In embodiments having latch regions 36, 46, latch regions 66, 70, and latch regions 68, 72, all three pairs of latch regions should be respectively latched to securely attach the removable container unit 14 to the base unit 12. It is contemplated that in some embodiments, there are no latch regions 70 and 66 and/or no latch regions 72 and 68. Thus, in some embodiments, the container system 10 can have any combination of the latch regions 36, 46; latch regions 66, 70; and latch regions 68, 72.

In embodiments having no rear latch regions 66, 60 and no rear latch regions 68, 72, the container system 10 may have other rear structures that prevent the removal of the removable container unit 14 from the base unit 12. For example, in one embodiment, a first fixed extending portion (not shown) may be provided on either the base unit 12 or the removable container unit 14 and a second fixed extending portion (not shown) may be provided on the other of the base unit 12 or the removable container unit 14, wherein the first extending portion and the second extending portion are constructed and arranged to interact with each other to prevent the removal of the removable container unit 14 from the base unit 12. For example, the first extending portion may be slid under the second extending portion when the removable container unit 14 is being attached to the base unit 12, thus preventing the removable container unit 14 from being removed from the base unit 12.

In embodiments having the latch regions 68, 72, the latch region 68 may be latched with the latch region 72 automatically. In embodiments having the latch regions 66, 70, the latch region 66 may be latched with the latch region 70 automatically. The operation of automatically latching the latch region 68 with latch region 72 in accordance with an embodiment will be described with respect to FIGS. 11*a*-11*c*. It is contemplated that the operation of latching the latch region 66 and 70 may occur in a similar manner.

As shown in FIG. 11*a*, the latch member 136 of the latch region 68 is in the default position, and the latch region 72 may be aligned with latch region 68 and pushed towards latch region 68. When the latch region 72 is pushed towards the latch region 68, the camming surface 141 of the latch region 72 contacts and pushes against the sliding surface 143 of the latching portion 140 of the latch member 136. This may pivot the latch member 136 in the clockwise direction against the bias of the extension portion 142, as shown in FIG. 11*b*. In this position shown in FIG. 11*b*, the latching portion 140 of the latch member 136 is positioned to the right of the latch engaging recess 138 of the latch region 72 of the container unit 14, and wherein the latching portion 140 of the latch member 136 does not obstruct the container unit 14. Accordingly, the container 14 may be moved closer to the base unit 12 and may be disposed on the base unit 12. In one embodiment, at least a portion of the bottom wall 56 of the container unit 14 may contact at least a portion of the base unit 12 when the container unit 14 is disposed on the base unit 12. When the container unit 14 is resting on the base unit 12, the latch engaging recess 138 may become aligned with the latching portion 140 of the latch member 136. Accordingly, the resilient properties of the latch member 136 and the extension portion 142 of the latch member 136 may snap the latch member 136 in the counterclockwise direction back to the default position. When the latch member 136 is pivoted back to the default position, the contact surface 150 of the latch member 136 may slide against the contact surface 152 of the latch region 72 until the latching portion 140 is received in the latch engaging recess 138, as shown in FIG. 11*c*, thereby latching the container unit 14 to the base unit 12. In this position, the first side contact portion 144 of the latch member 136 may abut against the second side contact portion 146 of the base unit 12. The contact between the contact surface 150 of the latch member 136 and the contact surface 152 of the latch region 72 may retain the latching portion 140 of the latch member 136 within the latch engaging recess 138 of the latch region 72, thus preventing the container unit 14 from being removed from the base unit 12. When the container unit 14 is attached to the base unit 12 in this embodiment, the container unit 14 may serve as a lid or cover for the base unit 12 and thus prevents access to the interior space 26 thereof.

In embodiments having latch regions 36, 46, latch regions 66, 70, and latch regions 68, 72, all three latch regions should be respectively unlatched to remove the removable container unit 14 from the base unit 12. An operation of manually unlatching the latch region 36 from the latch region 46 in accordance with an embodiment will be described. The latch region 36 may initially be latched to the latch region 46, as shown in FIG. 9*c*. The actuating member 58 may be manually depressed by the user to pivot the latch member 90 in the counterclockwise direction to the actuated position, as shown in FIG. 9*b*. When the latch member 90 is being moved to the actuated position, the first contact surface 96 of the latch member 90 may slide against the second contact surface 102 of the latch region 46 until the latching portion 94 of the latch member 90 is removed from the latch engaging recess 92. After the latching portion 94 of the latch member 90 has been removed from the latch engaging recess 92, the container unit 14 may be lifted away from the base unit 12 via the handle 44. In some embodiments, it is contemplated that a user may use one hand to actuate the actuating member 58 and grasp the handle 44 to unlatch and remove the container unit 14 from the base unit 12. The actuating member 58 may be released once the latch engaging recess 92 of the latch region 46 and the latching portion 94 of the latch member 90 are no longer aligned. Manually releasing the actuating member 58 enables the spring 104 to snap the latch member 90 in the clockwise direction back to the unactuated, default position shown in FIG. 9*a*. After the container unit 14 has been removed from the base unit 12, the container unit 14 may be carried via the handle 44 of the container unit 12. In some embodiments, the handle 44 may be a top carrying handle that enables the container unit 14 to be carried like a briefcase. That is, the container unit 14 may be carried via the handle 44 such that the front wall 48 of the container unit 14 is facing in a generally upward direction.

To remove the container unit 14 from the base unit 12, the latch region 72 should be unlatched from the latch region 68. In embodiments with the latch region 70 and latch region 66, the latch region 70 should also be unlatched from the latch region 66 to remove the container unit 14 from the base unit 12. The latch regions 66, 70 and the latch regions 68, 72 can be unlatched automatically. As used herein, "automatically" unlatched means unlatching of components of the container system 10 by action generated in response to or effected by the pushing or pulling of the removable container unit 14 to or from the base unit 12 by the user. As mentioned above, the latch region 46 should also be unlatched from the latch region 36 to remove the container unit 14 from the base unit 12.

In some embodiments, the latch region 46 should be unlatched from the latch region 36 before the latch region 72 is to be unlatched from the latch region 68. In such embodiments, unlatching the latch region 46 from the latch region 36 enables the user to commence lifting of the removable container unit 14 from the base unit 12 via the handle 44. This upward movement of the removable container unit 14 from the base unit 12 may effect the automatic unlatching of the latch region 72 from latch region 68. An operation of automatically unlatching the latch region 72 from the latch region 68 in accordance with an embodiment will be described. It is contemplated that the latch region 70 may be unlatched from latch region 66 in a similar manner.

The container unit 14 may be latched to the base unit 12 and the latch region 72 may be latched to the latch region, as shown in FIG. 11*c*. The latch region 46 may be unlatched from the latch region 36 as described above, and the container unit 14 may then be lifted from the base unit 12. When the container unit 14 is being lifted from the base unit 12, the latching portion 140 of the latch member 136 may be removed from the recess 138 of the container unit 14 and the extending portion 153 of the container unit 14 may be removed from the groove 151 of the latch member 136. In other words, the container unit 14 may be tilted when the container unit 14 is being lifted, thereby sliding the extending portion 153 of the container unit 14 from the groove 151 of the latch member 136 of the base unit 12 without moving the latch member 136. After the extending portion 153 of the container unit 14 is removed from the groove 151 of the latch member 136 and the latching portion 140 of the latch member 136 is removed from the recess 138 of the container unit 14, the latch region 68 is unlatched from the latch region 72 and the container unit 14 may be removed from the base unit 12.

Alternatively, in some embodiments, portions of the container unit 14 may cause the latch member 136 to move out of the way during the unlatching of the latch region 72 from the latch region 68. For example, when the container unit 14 is being lifted from the base unit 12, the contact surface 152 of the latch region 72 of the container unit 14 may push and slide against the contact surface 150 of the latch member 136. This contact may pivot the latch member 36 in the clockwise direction against the bias of the extension portion 132 to the position shown in FIG. 11*b*, thus removing the latching portion 140 from the latch engaging recess 138. The resiliency of the latch member 136 and the extension portion 142 of the latch member 136 may snap the latch member 136 back to the default position, as shown in FIG. 11*a*, wherein the side contact surface 144 of the latch member 136 may abut against the side contact surface 146 of the base unit 12. As such, the container unit 14 may be removed from the base unit 12 to be carried separately. When the container unit 14 is removed from the base unit 12, access to the interior space 26 of the base unit 12 is permitted.

As mentioned above, the handle 28 includes the locking structure 57 that enables the handle 28 to be moved between the locked position (see FIG. 13*a*) preventing rotation of the base handle 28 from the upright position to the lowered position and the unlocked position (see FIG. 12) permitting rotation of the base handle 28 from the upright position to the lowered position (see FIG. 2). In some embodiments, when the handle is in the lowered position, the container unit 14 may be unattached and removed from the base unit 12. In such an embodiment, the container unit 14 may not be unattached and removed from the base unit 12 when the handle 28 is in the upright position.

Figure 13C:
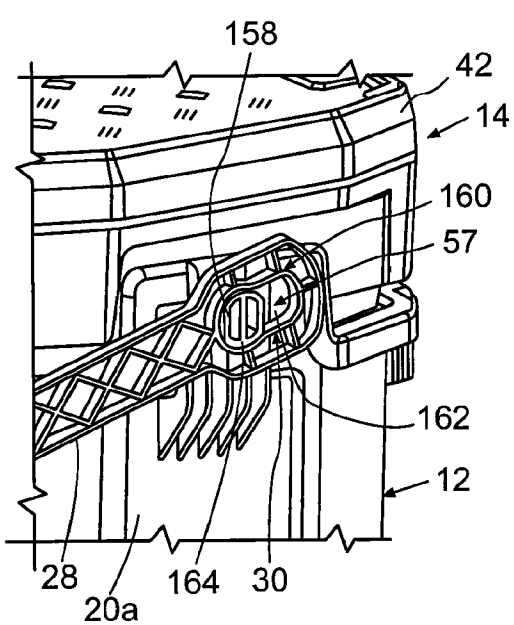
FIGS. 13*a*-13*c* are detailed views of a handle of the base unit of the container system in accordance with an embodiment.
Figure 13B:
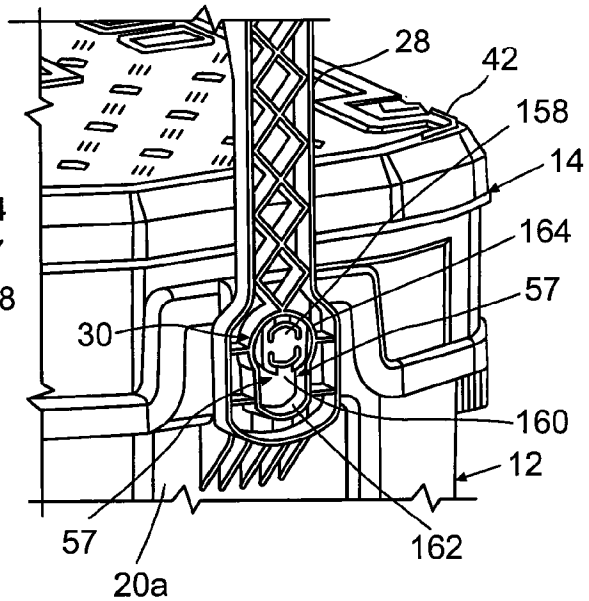
Figure 13A:
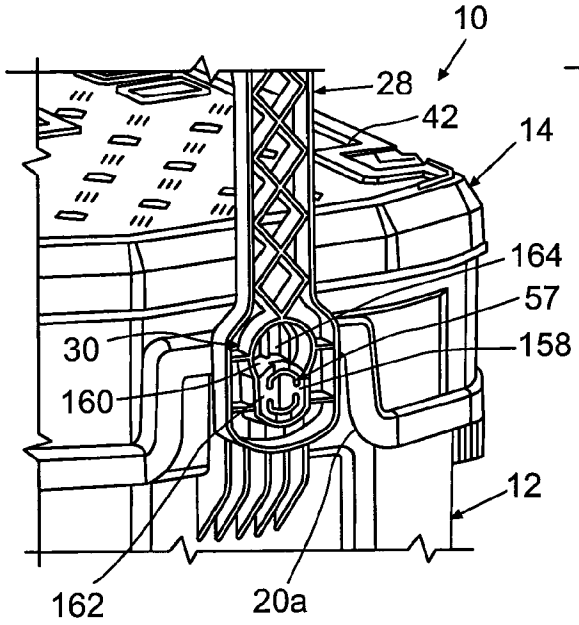

FIG. 13*a* is a detailed view of the handle locking structure 57 in the locked and upright position. In contrast, FIG. 13*b* shows the handle locking structure 57 in the unlocked and upright position, and FIG. 13*c* shows the handle 28 in the unlocked and lowered position. Referring back to FIG. 13*a*, the handle locking structure 57 is located on the side 20*a* of the base unit 12 and includes a locking member 158. A handle locking structure having a similar configuration and function as the handle locking structure 57 may be located on the side wall 20*b* of the base unit 12. In this embodiment, the locking member 158 is a generally hexagonal-shaped protrusion that extends from the side wall 20*a*. The end portion 30 of the handle 28 may be provided with an opening 160 therein. The opening 160 may include a lock portion 162 and a free portion 164. The locking member 158 of the base unit 12 may be received in the lock portion 162 of the opening 160 when the handle 28 is in the locked position. In contrast, the locking member 158 of the base unit 12 may be received in the free portion 164 of the opening 160 when the handle 28 is in the unlocked position. At least a portion of the lock portion 162 of the opening 160 may be similarly shaped as at least a portion of the locking member 158 and may have a similar size, thus enabling the lock portion 162 to receive the locking member 158 and prevent the rotation of the locking member 158. The free portion 164 of the opening 160 may have an arcuate shape, or a more circular shape, and/or may be larger than the circumference of the locking member 158, thus enabling the locking member 158 to rotate within the free portion 164. The handle 28 may be attached to the base unit 12 by receiving the locking member 158 of the base unit 12 in either the lock portion 162 or the free portion 164. In some embodiments, it is contemplated that the locking member 158 may include flanges (not shown) that retains the locking member 158 within the opening 160 of the handle 28.

Figure 12:
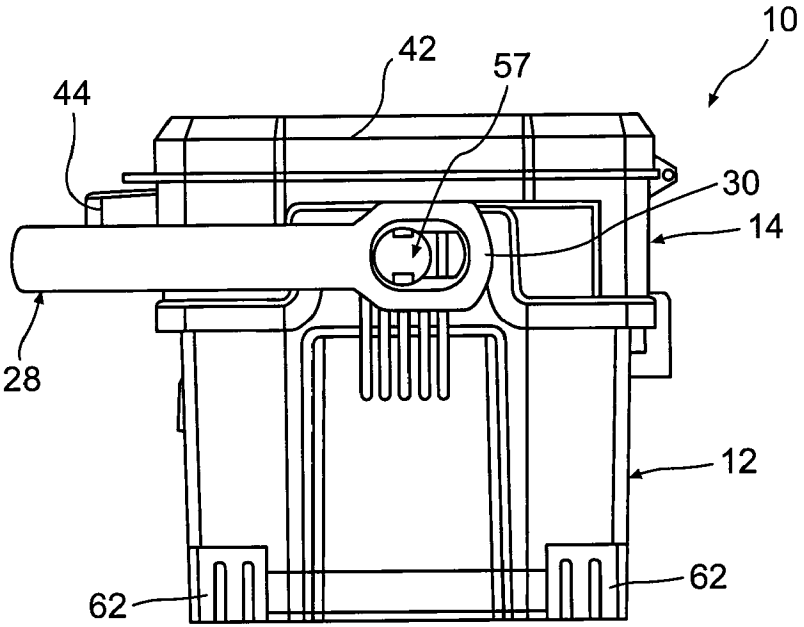
FIG. 12 is a side view of the container system in accordance with an embodiment.

The handle 28 may be moved between the locked position and the unlocked position as follows. The handle 28 may be in the locked and upright position as shown in FIG. 13*a*. In this position, the locking member 158 may be received in the lock portion 162 of the opening 160. As mentioned above, the lock portion 162 may have a similar shape as at least a portion of the locking member 158 and may have a similar size as the perimeter of the locking member 158, thus preventing the locking member 158 from rotating within the lock portion 162. To move the handle 28 to the unlocked position, the handle 28 may be pushed downward in the direction of A until the locking member 158 is moved from the lock portion 162 to the free portion 164 (see FIG. 13*b*). The free portion 164 may be circular, thus enabling the locking member 158 to rotate therein. Accordingly, when the locking member 158 is received in the free portion 164, the handle 58 may be rotated downward in the counterclockwise direction, as shown in FIG. 12, to the lowered position, shown in FIG. 13*c*. It is contemplated that in some embodiments, the handle 58 may also be rotated downward in the clockwise direction to the lowered position (towards the back wall 22*b*). In one embodiment, when the handle 28 is in the lowered position, the handle 28 may not be moved to the locked position (i.e., the locking member 158 may not be inserted into the lock portion 162). This may be due to the shape of the locking member 158 (e.g., elongated hexagonal) and the shape of the opening 162, as shown in FIG. 13*c*. However, it is contemplated that in some embodiments, the handle 28 may be moved to the locked position when the handle 28 is in the lowered position. When the handle 28 is in this lowered position, the container unit 14 may be attached to or removed from the base unit 12, as described above.

To move the handle 28 back to the upright and locked position from the unlocked and lowered position shown in FIG. 13*c*, the handle 28 may be rotated upwards in the clockwise direction until the handle is in the position shown in FIG. 13*b*. The handle 28 may then be pulled upwards in the direction opposite of A until the locking member 158 of the base unit 12 is moved from the free portion 164 to the lock portion 162, as shown in FIG. 13*a*. In this locked and upright position, the handle 28 may not be rotated and thus can facilitate the grasping of the container system 10. As mentioned above, in some embodiments, when the handle 28 is in this upright position, the container 14 cannot be removed from or attached to the base unit 12.

It is contemplated that any combination of the latch regions 46, 70, and 72 of the container unit 14 and the latch regions 36, 66, and 68 of the base unit 12 may be provided in the container system 10. It is also contemplated that the locking structures 57 of the base handle 28 may be eliminated in some embodiments.

Although the invention has been described in detail for the purpose of illustration of one or more embodiments, it is to be understood that such detail is solely for that purpose and that the invention is not limited thereto, but, on the contrary, is intended to cover modifications and equivalent arrangements that are within the spirit and scope of the appended claims. In addition, it is to be understood that the present invention contemplates that, to the extent possible, one or more features of any embodiment may be combined with one or more features of any other embodiment.

What is claimed is:

1. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the first latch region comprises an actuating member constructed and arranged to be actuated to unlatch the first latch region from the second latch region.

2. The container system of claim 1, wherein the removable container handle that facilitates transport of the removable container unit separately from the base unit is positioned to be on a vertical side of the container system.

3. The container system of claim 1, wherein the first latch region comprises a latch member and the second latch region comprises a latch engaging structure.

4. The container system of claim 3, wherein the latch is spring-biased and the latch engaging structure is constructed and arranged to push against the spring-biased latch to engage the latch engaging structure with the latch.

5. The container system of claim 1, wherein the removable container unit further comprises cover latches, the cover latches being constructed and arranged to latch the cover to the container portion in the closed condition.

6. The container system of claim 1, wherein the base unit further comprises a handle lock constructed and arranged to lock the handle in an upright position, the handle lock moveable between a locked position and an unlocked position.

7. The container system of claim 6, wherein the handle is permitted to be moved to a lowered position when the handle lock is in the unlocked position and is prevented from moving to the lowered position when the handle lock is in the locked position.

8. The container system of claim 1, wherein the extending portion of the base handle is spaced from the cover of the removable container unit when the base handle is in an upright position and the cover of the removable container unit is in the closed condition such that the removable container unit is removed from the base unit when the base handle is in the upright position.

9. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle connected to the base container portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space, a container handle to facilitate transport of the removable container unit separately from the base unit, a second latch region constructed and arranged to latch with the first latch region; and a fourth latch region constructed and arranged to latch with the third latch region, wherein the removable container unit is removable from the base unit when the first latch region is unlatched with the second latch region;

wherein the container handle is positioned so as to be on a vertical side surface of the container system when the second latch region is latched with the first latch region and forms a top carrying handle for the removable container unit when the removable container unit is removed from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the first latch region comprises an actuating member constructed and arranged to be actuated to unlatch the first latch region from the second latch region.

10. The container system of claim 9, wherein the first latch region comprises a latch member and the second latch region comprises a latch engaging structure.

11. The container system of claim 10, wherein the latch is spring-biased and the latch engaging structure is constructed and arranged to push against the spring-biased latch to automatically engage the latch engaging structure with the latch.

12. The container system of claim 9, wherein the removable container unit further comprises cover latches, the cover latches being constructed and arranged to latch the cover to the container portion in the closed condition.

13. The container system of claim 9, wherein the handle of the base unit has a first end attached to a first wall of the plurality of side walls, a second end attached to a second wall of the plurality of side walls, the second wall opposing the first side wall, and an extending portion extending between the first end and the second end, the extending portion traversing at least a portion of the opening of the base unit.

14. A container system comprising;

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle connected to the base container portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space, a container handle to facilitate transport of the removable container unit separately from the base unit, a second latch region constructed and arranged to latch with the first latch region; and a fourth latch region constructed and arranged to latch with the third latch region, wherein the removable container unit is removable from the base unit when the first latch region is unlatched with the second latch region;

wherein the container handle is positioned so as to be on a vertical side surface of the container system when the second latch region is latched with the first latch region and forms a top carrying handle for the removable container unit when the removable container unit is removed from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the first latch region is positioned proximate to the handle of the removable container unit such that a user can disengage the first latch region from the second latch region and grasp the handle of the removable container unit using one hand.

15. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the resilient latch member is disposed on the third latch member.

16. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the first latch region is disposed on one of the second pair of opposing walls and the third latch region is disposed on the other of the second pair of opposing walls.

17. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the resilient latch member is constructed and arranged to be movable against the bias thereof to a release position when the removable container unit is pulled away from the base unit wherein the removable container unit is able to be removed from the base unit.

18. A container system comprising:

a base unit comprising i) a base container portion having walls, including at least a first pair of opposing side walls and a second pair of opposing side walls, the side walls defining an opening into an interior space in which articles to be transported be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the unlatching between the third latch region and the fourth latch region is generated in response to or effected by a predefined movement of the removable container unit relative to the base unit.

19. A container system comprising:

a base unit comprising i) a base container portion having walls, including at least a first pair of opposing side walls and a second pair of opposing side walls, the side walls defining an opening into an interior space in which articles to be transported can be stored, the second pair of opposing side walls disposed on a front side and rear side of the container system, respectively, ii) a base handle having a first end portion attached to one of the first pair of opposing side walls, a second end portion attached to the other of the first pair of opposing side walls, and an extending portion extending between the first end portion and the second end portion, and iii) a first latch region and a third latch region; and a removable container unit constructed and arranged to be removably attached to the base unit, the removable container unit preventing access to the opening of the base unit when the removable container unit is attached to the base unit and permitting access to the opening of the base unit when the removable container unit is removed from the base unit, the removable container unit comprising:

a removable container portion having a storage space for storing items, a cover movable between an open condition permitting access to the storage space and a closed condition preventing access to the storage space;

a second latch region constructed and arranged to latch with the first latch region; and a fourth latch region constructed and arranged to latch with the third latch region, wherein the removable container unit is attached to the base unit when the first latch region is latched with the second latch region and the third latch region is latched with the fourth latch region and is removable from the base unit when the first latch region is unlatched with the second latch region, wherein the extending portion of the base handle is constructed and arranged to traverse over the removable container unit when the removable container unit is attached to the base unit, wherein the removable container unit further comprises a container handle to facilitate transport of the removable container unit separately from the base unit, wherein a locking engagement between the third latch region and the fourth latch region includes at least one resilient latch member, the resilient latch member being biased into a lock position during engagement between the third latch region and the fourth latch region to prevent the removable container unit from being removed from the base unit, wherein unlatching the first latch region from the second latch region enables unlatching between the third latch region and the fourth latch region to permit the removal of the removable container unit from the base unit, and wherein the first latch region is unlatched from the second latch region before the third latch region can be unlatched from the fourth latch region, wherein unlatching the first latch region from the second latch region enables a user to commence movement of the removable container unit relative to the base unit, and wherein continued movement of the removable container unit relative to the base unit effects an automatic unlatching between the third latch region and the fourth latch region.

* * * * *